US011504989B2

(12) United States Patent
Eto

(10) Patent No.: US 11,504,989 B2
(45) Date of Patent: Nov. 22, 2022

(54) INKJET RECORDING DEVICE

(71) Applicant: KYOCERA Document Solutions Inc., Osaka (JP)

(72) Inventor: Daisuke Eto, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 17/201,039

(22) Filed: Mar. 15, 2021

(65) Prior Publication Data

US 2021/0291570 A1 Sep. 23, 2021

(51) Int. Cl.
*B41J 25/304* (2006.01)

(52) U.S. Cl.
CPC ..... *B41J 25/304* (2013.01)

(58) Field of Classification Search
None
See application file for complete search history.

(56) References Cited

U.S. PATENT DOCUMENTS 7,270,387 B2 * 9/2007 Ueda ..... B41J 2/145 347/8

FOREIGN PATENT DOCUMENTS

JP 2010-097196 4/2010

* cited by examiner

*Primary Examiner* — Alejandro Valencia
(74) *Attorney, Agent, or Firm* — Lex IP Meister, PLLC

(57) ABSTRACT

An inkjet recording device has a head base, a head unit, and an adjustment mechanism. The adjustment mechanism has a guide screw, a moving member, the operation member for rotating the moving member, and an adjusting member. The moving member has a shaft hole screwed into the guide screw, and moves in an axial direction of the guide screw by rotating with respect to the guide screw. The adjusting member has a first contact portion in contact with the moving member and a second contact portion in contact with the head unit. The second contact portion moves in a direction toward the head unit and a direction away from the head unit, by moving the moving member in contact with the first contact portion in the axial direction of the guide screw.

7 Claims, 15 Drawing Sheets

INKJET RECORDING DEVICE

INCORPORATION BY REFERENCE

This application is based upon, and claims the benefit of priority from, corresponding Japanese Patent Application No. 2020-049647 filed in the Japan Patent Office on Mar. 19, 2020, the entire contents of which are incorporated herein by reference.

BACKGROUND

Field of the Invention

The present disclosure relates to an inkjet recording device including a head unit for ejecting ink.

Description of Related Art

The inkjet recording device includes a head unit including a recording head that ejects ink. The head unit is attached to a base member for the head unit. For example, the base member has a mounting space. The head unit is inserted into the mounting space. This results in a state where the head unit is mounted on the base member.

Here, in general, after inserting the head unit into the mounting space, the position of the head unit in the mounting space is adjusted. For example, it is common to provide a mechanism for finely adjusting the position of the head unit by pressing the head unit.

Various mechanisms have been proposed for adjusting the position by pressing an object to be adjusted.

SUMMARY

An inkjet recording device according to the present disclosure has a head base having a mounting space, a head unit including a recording head for ejecting ink, and an adjustment mechanism for adjusting a position of the head unit inserted in the mounting space, in the mounting space. The adjustment mechanism has a guide screw, a moving member having a shaft hole screwed into the guide screw, and moving in an axial direction of the guide screw by rotating with respect to the guide screw, an operation member for rotating the moving member, and an adjusting member having a first contact portion in contact with the moving member and a second contact portion in contact with the head unit. The second contact portion moves in a direction toward the head unit and a direction away from the head unit, by moving the moving member in contact with the first contact portion in the axial direction of the guide screw.

DETAILED DESCRIPTION

Hereinafter, the inkjet recording device according to one embodiment of the present disclosure will be described using an inkjet recording printer by way of example.

<Printer Configuration>

Figure 1:
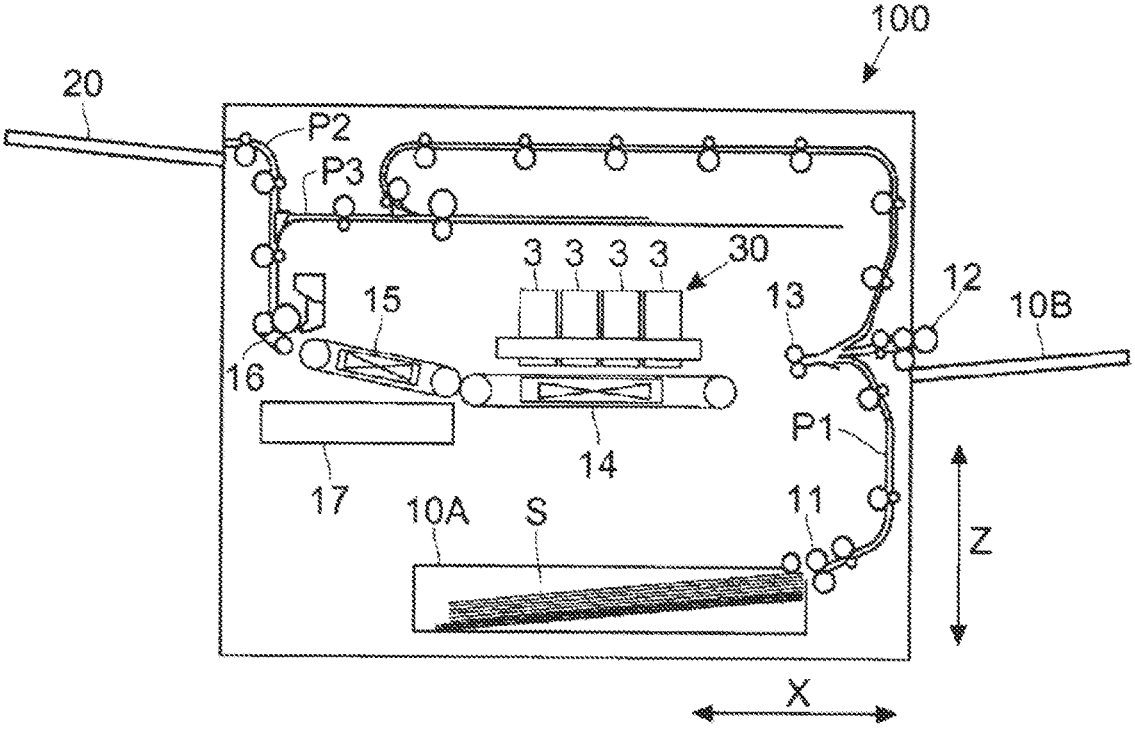
FIG. 1 is a schematic view of a printer according to one embodiment of the present disclosure.

As shown in FIG. 1, a printer 100 of this embodiment includes a paper feed cassette 10A and a manual feed tray 10B. The printer 100 also includes a discharge tray 20. A sheet feeding device 11 for the paper feed cassette is arranged on the downstream side of the paper feed cassette 10A in the sheet transport direction (on the right side of the paper feed cassette 10A in FIG. 1). A sheet feeding device 12 for the manual feed tray is arranged on the downstream side of the manual feed tray 10B in the sheet transport direction (on the left side of the manual feed tray 10B in FIG. 1).

The sheet feeding device 11 supplies sheets S set in the paper feed cassette 10A one by one to a first sheet transport path P1. The sheet feeding device 12 supplies the sheets S set in the manual feed tray 10B one by one to the first sheet transport path P1. The sheet S supplied to the sheet transport path P1 is transported toward a resist roller pair 13.

At the time the sheet S reaches the resist roller pair 13, the resist roller pair 13 has stopped rotating. When the sheet S abuts against the resist roller pair 13 during stoppage of rotation, the skew of the sheet S is corrected.

A first transport belt 14 is installed on the downstream side of the resist roller pair 13 in the sheet transport direction. The first transport belt 14 is an endless belt. The first transport belt 14 is stretched around a drive roller and a driven roller. The rotation of the drive roller causes the first transport belt 14 to rotate.

The resist roller pair 13 transports the sheet S toward the first transport belt 14. The sheet S reaches above the first transport belt 14. The first transport belt 14 is formed with a suction hole that penetrates in the thickness direction of the belt. Further, a suction unit is installed on the back side of the outer peripheral surface of the first transport belt 14 (inside the outer circumference of the first transport belt 14). The suction unit generates negative pressure, and sucks the sheet S on the first transport belt 14. As a result, the sheet S on the first transport belt 14 is transported.

During the transport of the sheet S by the first transport belt 14, a recording unit 30 performs printing for the sheet S on the first transport belt 14. The recording unit 30 includes four head units 3. The four head units 3 correspond to cyan, magenta, yellow and black, respectively. Each head unit 3 is mounted on a head base 4 (see FIG. 2). By mounting each head unit 3 on the head base 4, each head unit 3 is in a state of being arranged above the first transport belt 14.

Each head unit 3 ejects ink toward the first transport belt 14 while the sheet S is being transported by the first transport belt 14 (when the sheet S is on the first transport belt 14). The ink ejected from each head unit 3 lands on the sheet S. This allows an image to be printed on the sheet.

Figure 2:
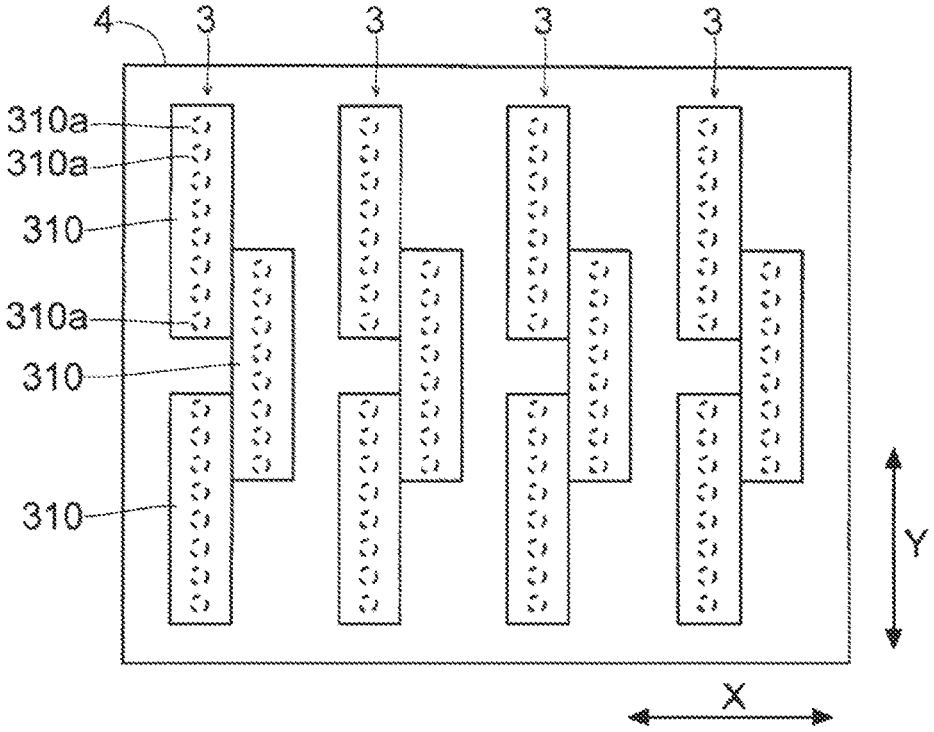
FIG. 2 is a diagram showing a recording head included in a printer head unit according to one embodiment of the present disclosure.

As shown in FIG. 2, each head unit 3 is provided with three recording heads 310 for ejecting inks of corresponding colors. Each recording head 310 has a nozzle surface. A plurality of nozzles 310*a* for ejecting ink are formed on the nozzle surface.

Returning to FIG. 1, a second transport belt 15 is installed on the downstream side of the first transport belt 14 in the sheet transport direction. The second transport belt 15 is an endless belt. The second transport belt 15 is stretched around a drive roller and a driven roller. The rotation of the drive roller causes the second transport belt 15 to rotate.

The first transport belt 14 transports the sheet S toward the second transport belt 15. That is, the printed sheet S reaches above the second transport belt 15. The second transport belt 15 is formed with a suction hole that penetrates in the thickness direction of the belt. Further, a suction unit is installed on the back side of the outer peripheral surface of the second transport belt 15 (inside the outer circumference of the second transport belt 15). The suction unit generates negative pressure, and sucks the sheet S on the second transport belt 15. As a result, the sheet S on the second transport belt 15 is transported.

A decurler 16 is installed on the downstream side of the second transport belt 15 in the sheet transport direction. The second transport belt 15 transports the sheet S toward the decurler 16. If the sheet S is curled, the decurler 16 corrects the curl.

The sheet S that has passed through the decurler 16 is supplied to a second sheet transport path P2. The sheet S transported along the second sheet transport path P2 is discharged to the discharge tray 20.

When performing double-sided printing, the sheet S that has passed through the decurler 16 is drawn into a reverse transport path P3. The sheet S transported along the reverse transport path P3 is switched back and returned to the first sheet transport path P1 (upstream side of the first transport belt 14 in the sheet transport direction). This results in a state where the directions of the front and back surfaces of the sheet S are reversed. After that, the sheet S is transported again by the first transport belt 14. At this time, since the unprinted side of both sides of the sheet S faces upward, printing is performed on the unprinted side of the sheet S.

A maintenance unit 17 is installed below the second transport belt 15. The maintenance unit 17 maintains the recording unit 30. The maintenance unit 17 moves below the recording unit 30, when performing maintenance on the recording unit 30.

<Installation of Head Unit>

Figure 3:
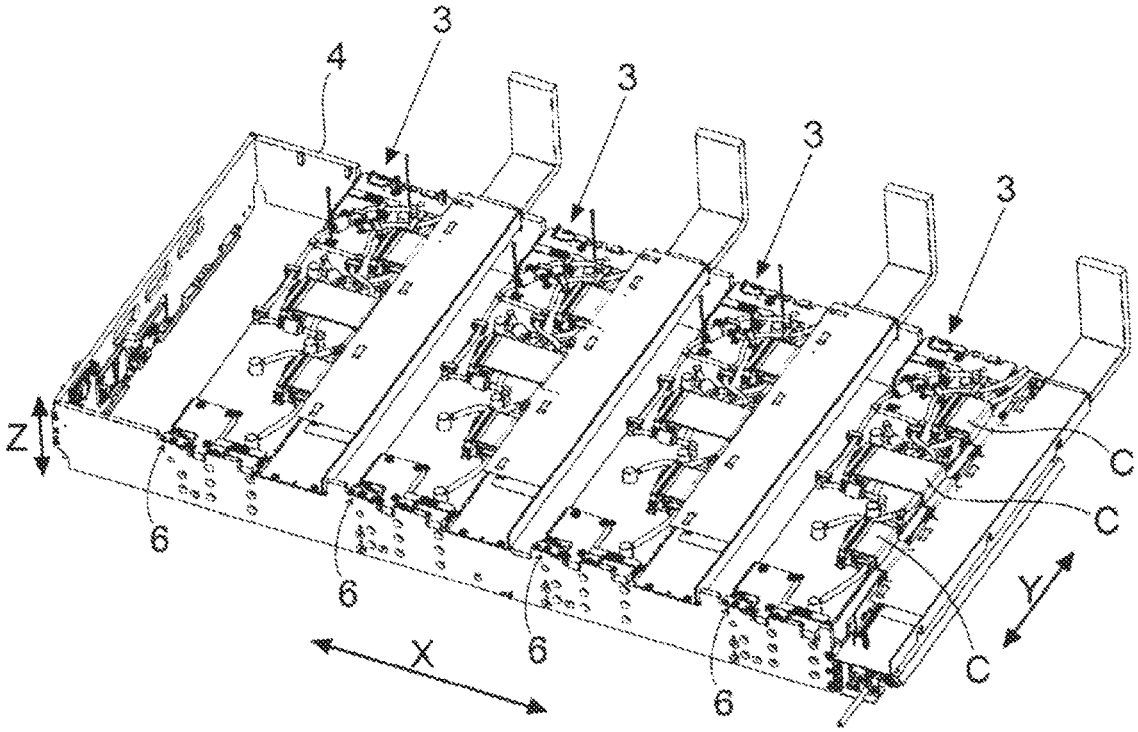
FIG. 3 is a perspective view showing a state in which the printer head unit according to one embodiment of the present disclosure is mounted to the head base.

In the present embodiment, as shown in FIG. 3, head units 3 for four colors are mounted on the single head base 4. The head base 4 is provided with four mounting spaces 40 (see FIG. 8) corresponding to the head units 3 for four colors. Each head unit 3 is inserted into a corresponding mounting space 40 from above the head base 4, when it is mounted on the head base 4. Note that FIG. 3 is a perspective view of the printer 100 when viewed from the front upper right.

In the following description, the sheet transport direction is referred to as an X direction, and the direction horizontally orthogonal to the X direction is referred to as a Y direction. The direction orthogonal to both the X direction and the Y direction is referred to as a Z direction. The Z direction is the vertical (up-down) direction of the printer 100. The Y direction is the front-back direction of the printer 100. The X direction is the left-right direction of the printer 100.

Figure 4:
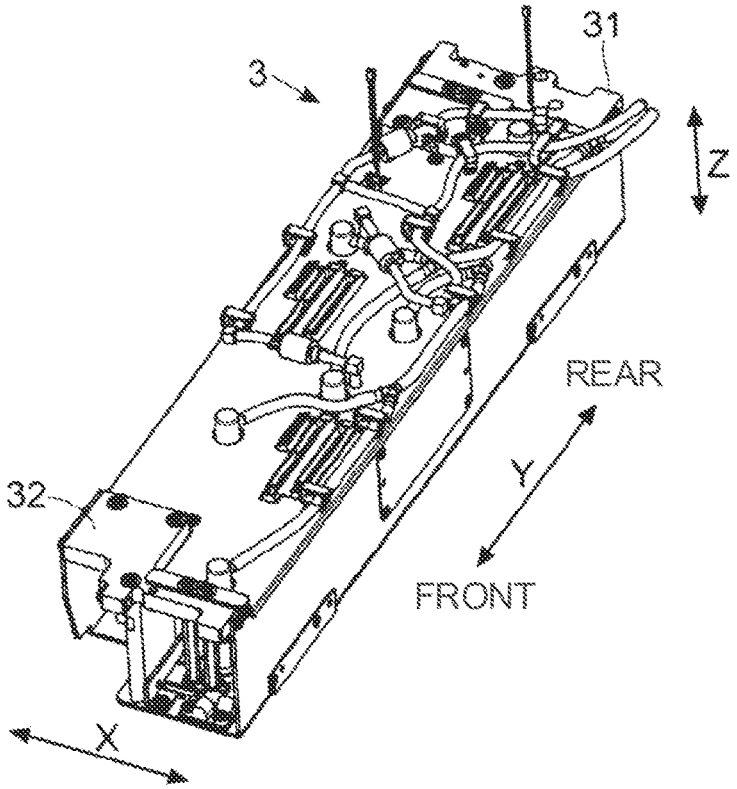
FIG. 4 is a perspective view of the printer head unit according to one embodiment of the present disclosure, as viewed from above on the front side.
Figure 5:
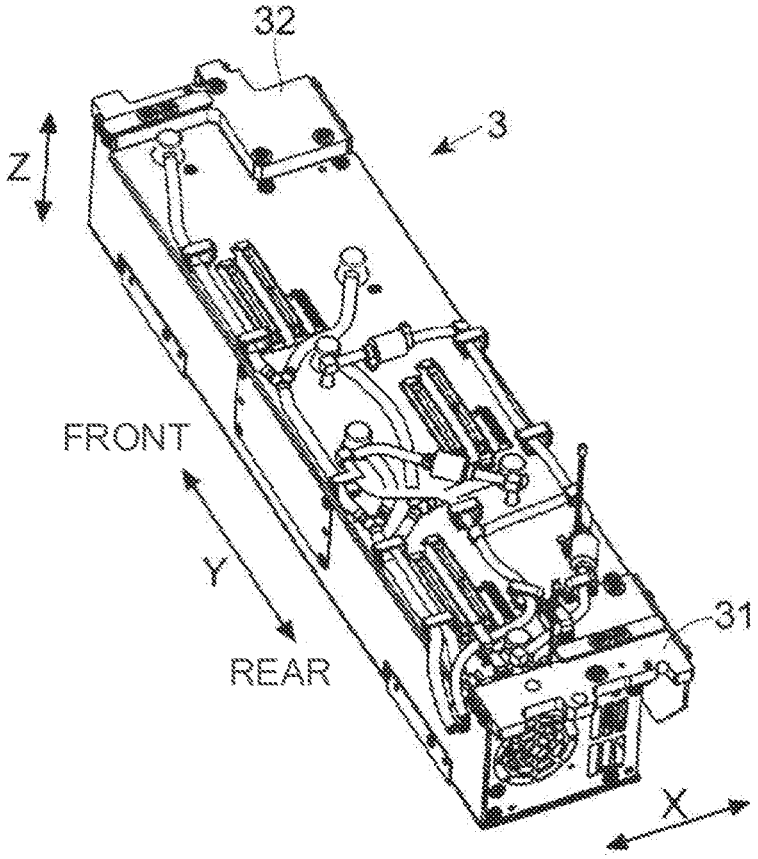
FIG. 5 is a perspective view of the printer head unit according to one embodiment of the present disclosure, as viewed from above on the rear side.

As shown in FIGS. 4 and 5, each head unit 3 has a rear positioning portion 31 and a front positioning portion 32. The rear positioning portion 31 is located on the rear side in the Y direction. The front positioning portion 32 is located on the front side in the Y direction.

Figure 6:
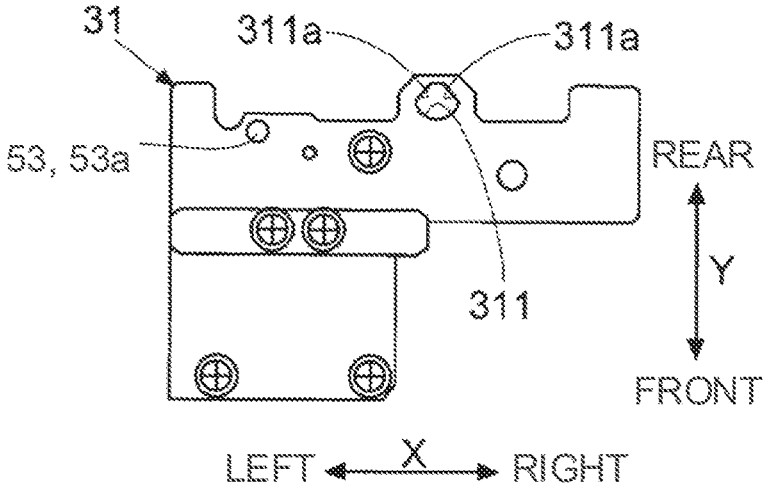
FIG. 6 is a plan view of a rear-side positioning portion of the printer head unit according to one embodiment of the present disclosure.
Figure 7:
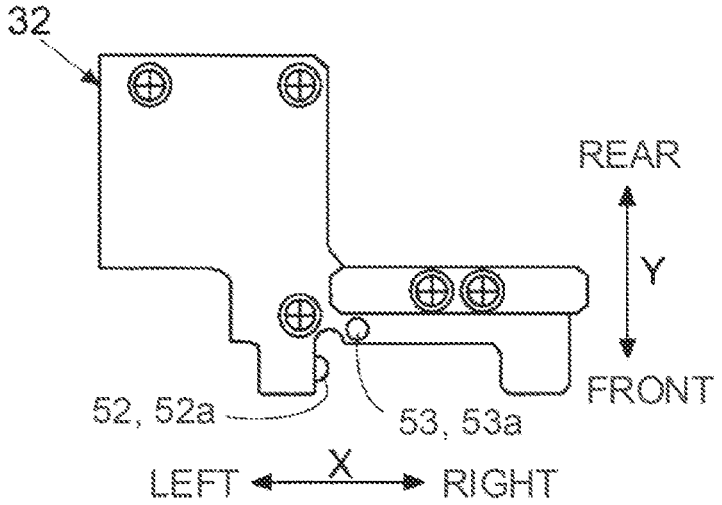
FIG. 7 is a plan view of a front-side positioning portion of the printer head unit according to one embodiment of the present disclosure.

The rear positioning portion 31 and the front positioning portion 32 are each made of a metal member. A plan view of the rear positioning portion 31 (viewed from above in the Z direction) is shown in FIG. 6, and a plan view of the front positioning portion 32 (viewed from above in the Z direction) is shown in FIG. 7.

The rear positioning portion 31 has a positioning hole 311 penetrating in the Z direction. The positioning hole 311 is formed in a fan shape, when viewed in a plane. Specifically, the positioning hole 311 has a pair of inner side surfaces 311*a* that radiate from the rear side to the front side in the Y direction.

Figure 8:
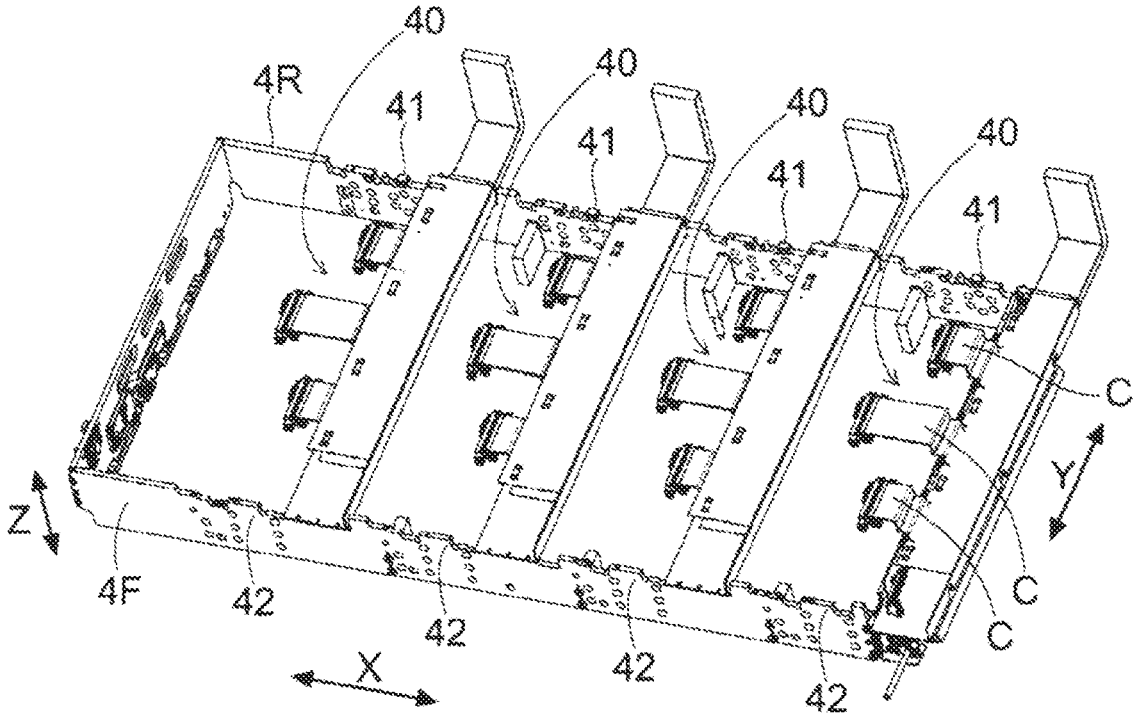
FIG. 8 is a perspective view of a printer head base according to one embodiment of the present disclosure.

The head base 4 has a rear plate 4R and a front plate 4F, as shown in FIG. 8. The rear plate 4R and the front plate 4F are each made of metal.

The rear plate 4R and the front plate 4F are arranged so that their main surfaces (planes perpendicular to the plate thickness direction) face each other in the Y direction. The area sandwiched between the main surfaces of the rear plate 4R and the front plate 4F is divided into four. Each of the four areas is a mounting space 40.

Figure 9:
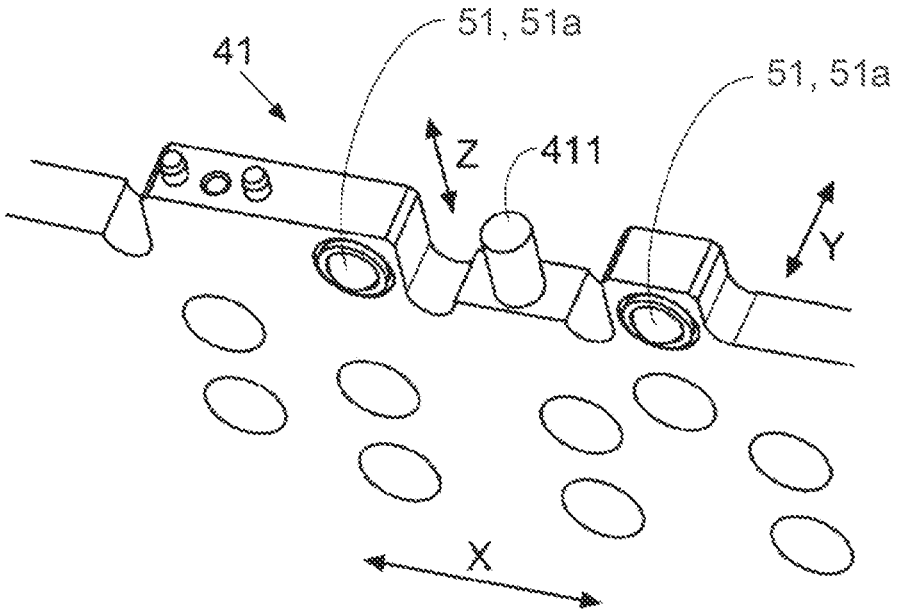
FIG. 9 is a perspective view of a rear-side mounting portion of the printer head base according to one embodiment of the present disclosure.
Figure 10:
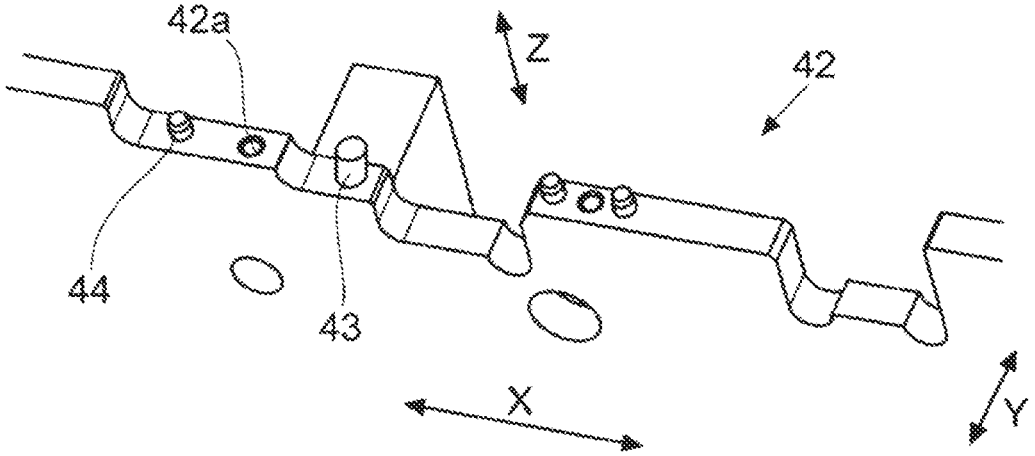
FIG. 10 is a perspective view of a front-side mounting portion of the printer head base according to one embodiment of the present disclosure.

In the following description, of the rear plate 4R, four portions 41 corresponding to the four mounting spaces 40 are referred to as rear mounting portions 41. Further, of the front plate 4F, four portions 42 corresponding to the four mounting spaces 40 are referred to as front mounting portions 42. An enlarged view of the rear mounting portion 41 is shown in FIG. 9, and an enlarged view of the front mounting portion 42 is shown in FIG. 10.

Each rear mounting portion 41 has a positioning pin 411 that is erected upright in the Z direction. Each positioning pin 411 is used to position the head unit 3 inserted into the corresponding mounting space 40.

When each head unit 3 is mounted on the head base 4, each head unit 3 is inserted into the corresponding mounting space 40 from above the head base 4 (upper side in the Z direction). At this time, the positioning pin 411 is inserted into the positioning hole 311 (see FIG. 6) of each head unit 3. This results in a state shown in FIG. 3. In FIG. 3, the member with the reference numeral C is a flexible printed substrate, and can be moved out of the way when each head unit 3 is mounted.

Here, each head unit 3 is pressed by a pressing member in the corresponding mounting space 40. As a result, each head unit 3 is fixed (held so as not to rattle) in the corresponding mounting space 40. A ball plunger is used as a pressing member. The ball plunger includes a cylindrical plunger case, a ball inserted into the plunger case so that a part of the plunger case protrudes from the inside to the outside, and a spring that urges the ball inside the plunger case from the inside to the outside of the plunger case.

Hereinafter, a holding mechanism of each head unit 3 will be specifically described. The configuration of the holding mechanism is common to each of the head units 3. Therefore, the configuration of the holding mechanism will hereinafter be described focusing on one head unit 3, and thus no description will be made to the configuration of the holding mechanism of other head units 3.

The head unit 3 is pressed in the Y direction by a first ball plunger 51 as a pressing member, in the mounting space 40. The first ball plunger 51 is attached to the rear mounting portion 41 as shown in FIG. 9. That is, the plunger case of the first ball plunger 51 is attached to the rear mounting portion 41. A ball 51*a* of the first ball plunger 51 projects from the rear side to the front side in the Y direction. The number of first ball plungers 51 installed is two. One first plunger 51 is installed on each of the left side and the right side of the positioning pin 411 in the X direction.

Figure 11:
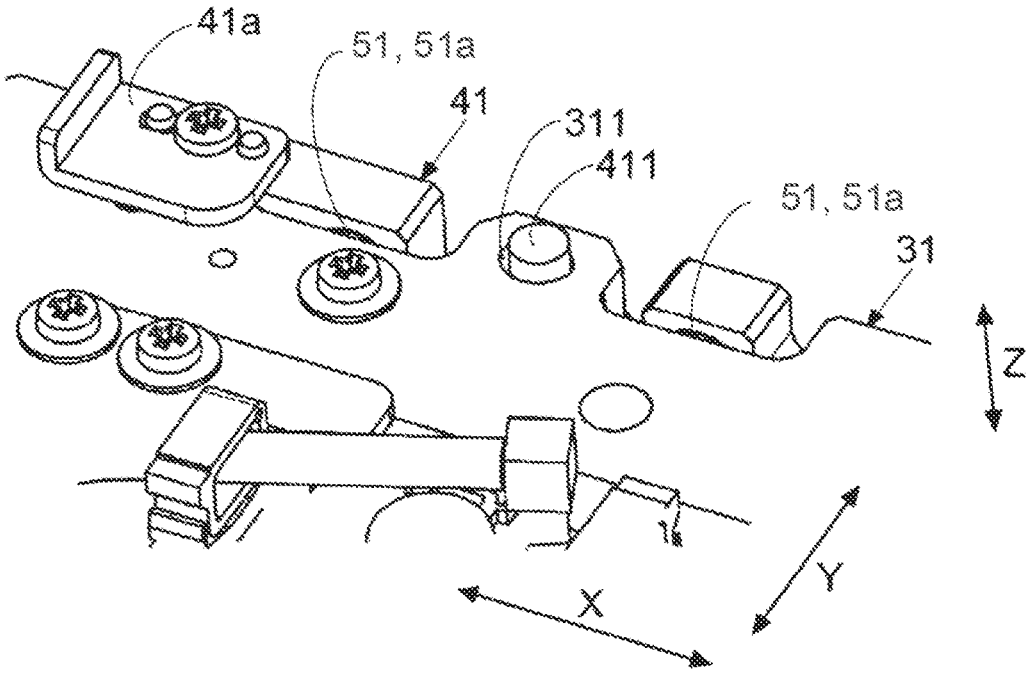
FIG. 11 is a perspective view (a perspective view of a rear portion of the head unit) in a state where the head unit is mounted to the printer head base according to one embodiment of the present disclosure.

As shown in FIG. 11, the ball 51*a* of the first ball plunger 51 comes into contact with the rear positioning portion 31. This results in a state where the head unit 3 is pressed from the rear side to the front side in the Y direction. By pressing the head unit 3 in this way, the state in which the pair of inner side surfaces 311*a* of the positioning holes 311 are in contact with the positioning pins 411 is maintained. As a result, the rotation shaft is defined at the time of rotating the head unit 3 with respect to the head base 4 to adjust the position. Further, it is possible to cause the rotation axis hardly to shift, by defining the rotation axis with the positioning hole 311 and a positioning pin 411 that are arranged between the two first ball plungers 51.

Further, the head unit 3 is pressed in the X direction by a second ball plunger 52 as a pressing member in the mounting space 40. The second ball plunger 52 is attached to the front positioning portion 32 as shown in FIG. 7. That is, the plunger case of the second ball plunger 52 is attached to the front positioning portion 32. A ball 52*a* of the second ball plunger 52 projects from the left side to the right side in the X direction.

Figure 12:
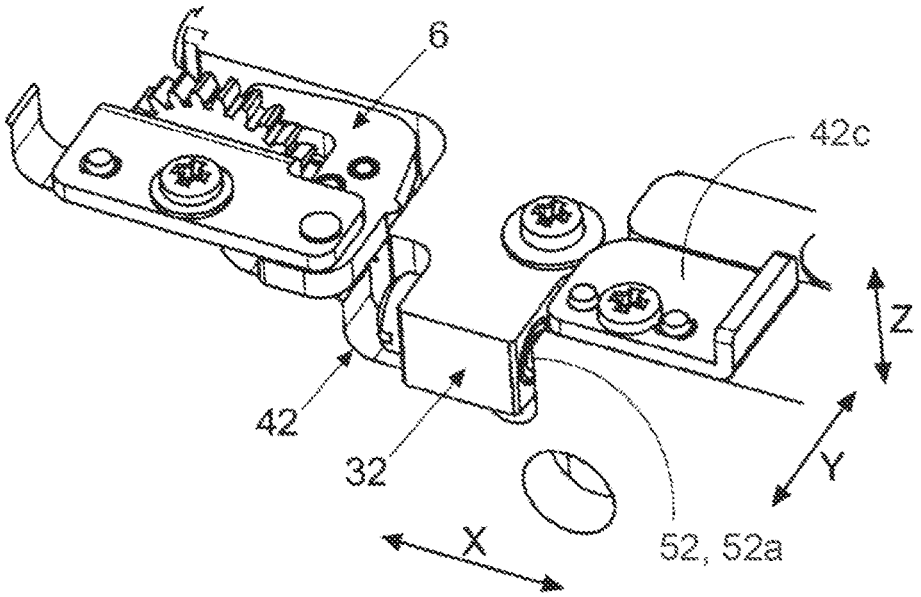
FIG. 12 is a perspective view (a perspective view of a front portion of the head unit) in a state where the head unit is mounted to the head base of the printer according to one embodiment of the present disclosure.

As shown in FIG. 12, the ball 52*a* of the second ball plunger 52 comes into contact with the front mounting portion 42. This results in a state where the head unit 3 is pressed from the right side to the left side in the X direction. By pressing the head unit 3 in this way, the front positioning portion 32 is maintained in the state where it comes into contact with a part of an adjustment mechanism 6 as will be described later.

Further, the head unit 3 is pressed in the Z direction by a third ball plunger 53 in the mounting space 40. As shown in FIGS. 6 and 7, the third ball plunger 53 is attached to each of the rear positioning portion 31 and the front positioning portion 32. That is, the plunger case of the third ball plunger 53 is attached to each of the rear positioning portion 31 and the front positioning portion 32. Balls 53*a* of the third ball plungers 53 of the rear positioning portion 31 and the front positioning portion 32 respectively project from the lower side to the upper side in the Z direction.

As shown in FIG. 11, the ball 53*a* of the third plunger 53 of the rear positioning portion 31 comes into contact with a pressing plate 41*a* attached to the rear mounting portion 41. As shown in FIG. 12, the ball 53*a* of the third ball plunger 53 of the front positioning portion 32 comes into contact with a pressing plate 42*c* attached to the front mounting portion 42. This results in a state where the head unit 3 is pressed from the upper side to the lower side in the Z direction. The pressing plates 41*a* and 42*c* are attached to the head base 4, after the head units 3 are inserted to the mounting space 40.

Figure 13:
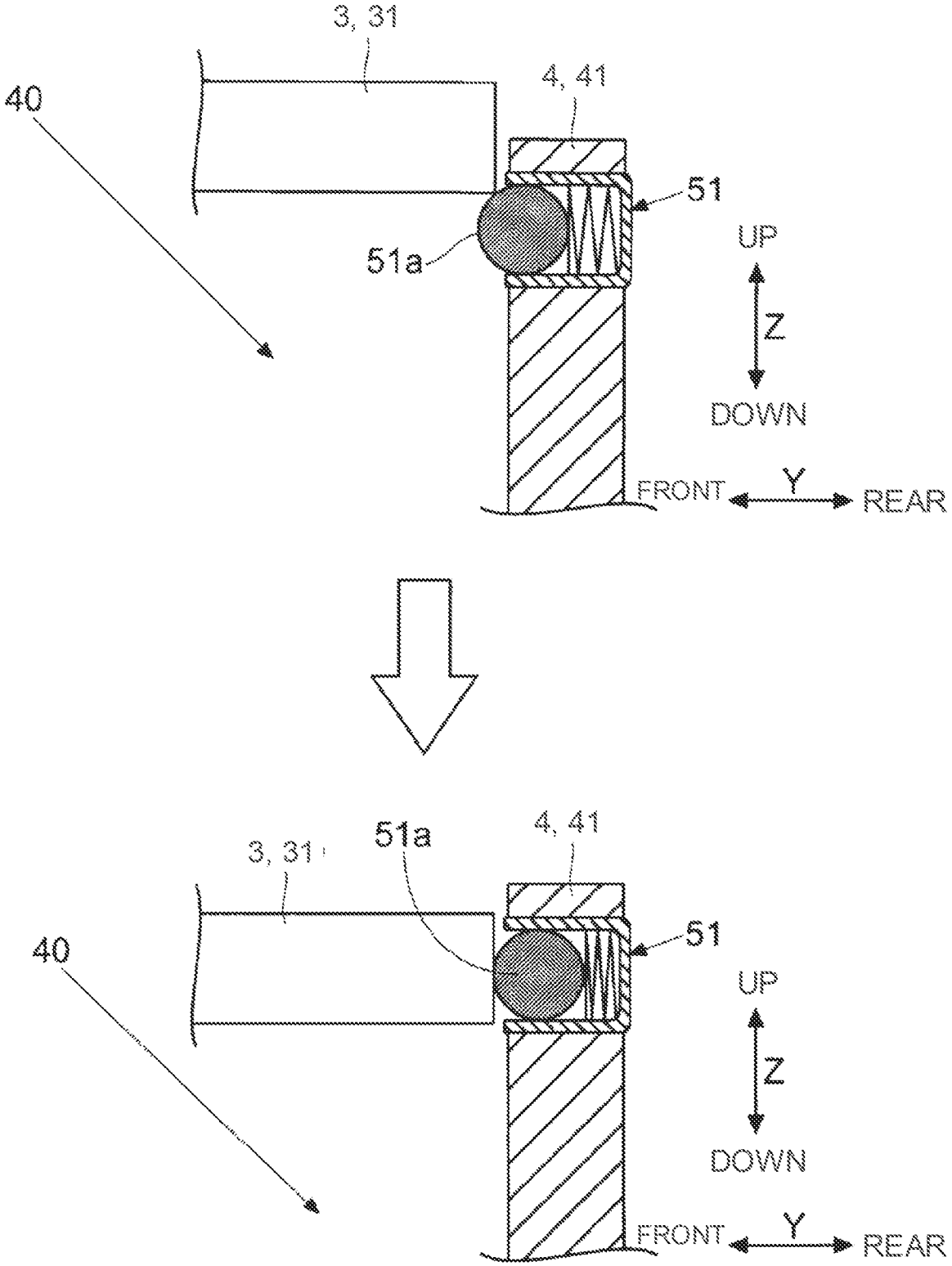
FIG. 13 is a diagram showing a state of a ball plunger when the head unit is inserted into the mounting space of the printer head base according to one embodiment of the present disclosure.

When the head unit 3 is mounted on the head base 4, the head unit 3 is inserted to the mounting space 40 from the upper side in the Z direction. Therefore, as shown in the upper figure of FIG. 13, the head unit 3 comes into contact with the upper side portion of the ball 51*a* of the first ball plunger 51. Then, when the head unit 3 is further inserted downward from the state shown in the upper figure of FIG. 13, the ball 51*a* of the first ball plunger 51 is in a state where it is pushed toward the inside of the plunger case, as shown in the lower figure of FIG. 13.

Further, although not shown, when the head unit 3 is mounted on the head base 4, the head base 4 (front mounting portion 42) comes into contact with the lower side portion of the ball 52*a* of the second ball plunger 52. From that state, when the head unit 3 is further inserted downward, the ball 52*a* of the second ball plunger 52 is pushed toward the inside of the plunger case.

In this way, when the head unit 3 is inserted to the mounting space 40, the ball 51*a* of the first ball plunger 51 and the ball 52*a* of the second ball plunger 52 are pushed into the plunger cases, respectively. Thus, it prevents an obstacle to the insertion work of the head unit 3.

<Adjusting Position of Head Unit>

In the present embodiment, as shown in FIG. 3, the adjustment mechanism 6 is installed in each mounting space 40 of the head base 4. Each adjustment mechanism 6 is a mechanism for adjusting the position of the head unit 3 inserted into the corresponding mounting space 40.

The adjustment mechanism 6 corresponding to each head unit 3 will be specifically described below. The configuration of the adjustment mechanism 6 is common to each of the head units 3. Therefore, here, the configuration of the adjustment mechanism 6 corresponding to one specific head unit 3 will be described, and thus no description will be made to the configuration of the adjustment mechanism 6 corresponding to the other head units 3.

Figure 14:
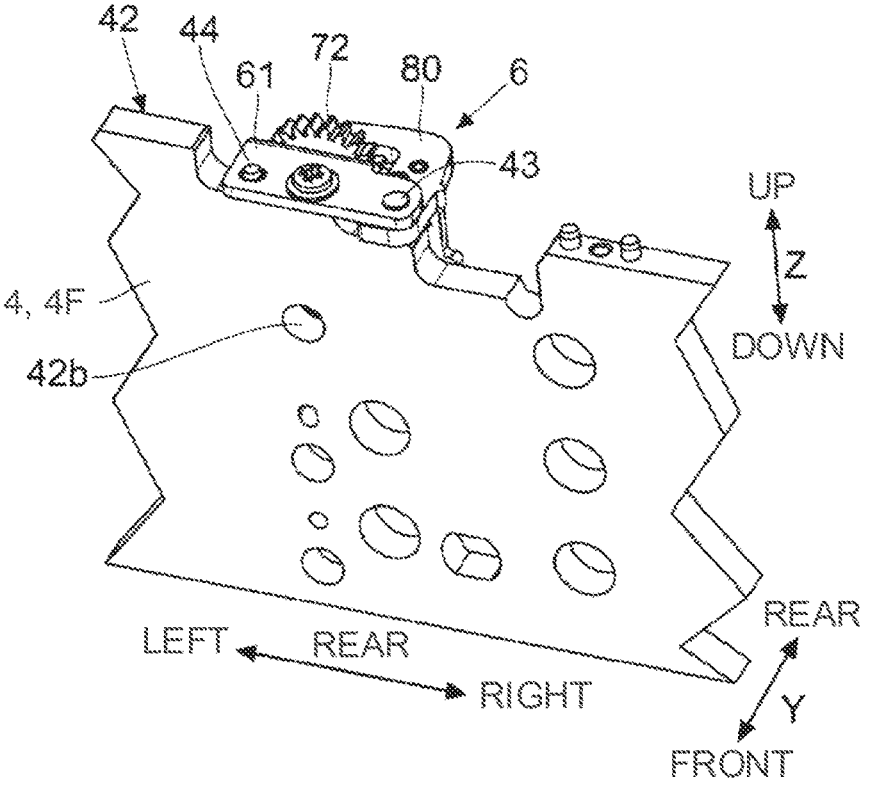
FIG. 14 is a perspective view of an adjustment mechanism of the printer according to one embodiment of the present disclosure, as viewed from the outside of the mounting space.
Figure 15:
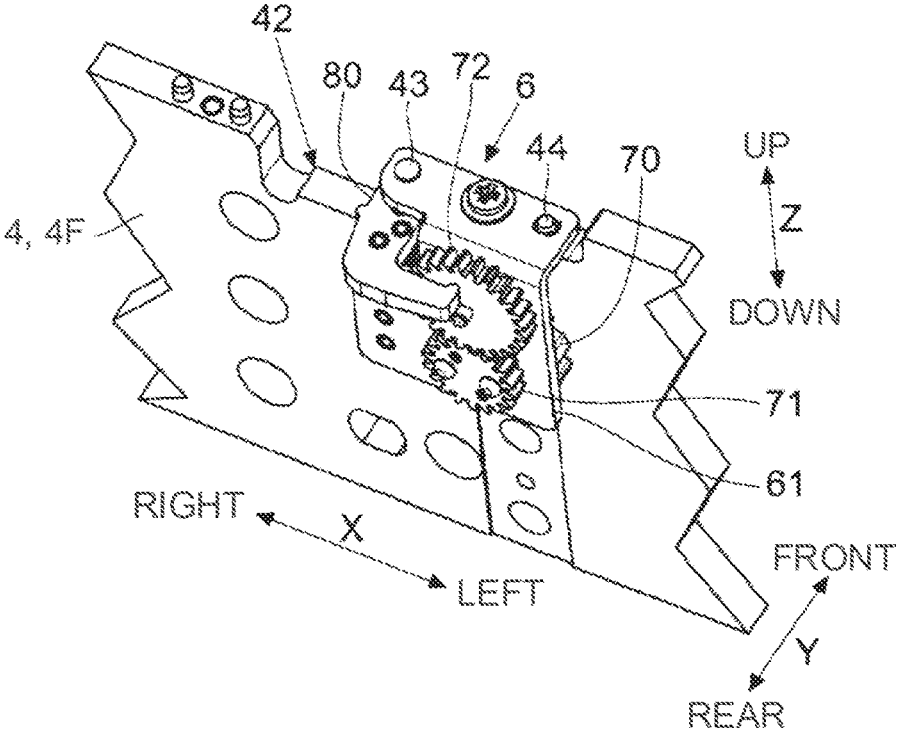
FIG. 15 is a perspective view of the adjustment mechanism of the printer according to one embodiment of the present disclosure, as viewed from the inside of the mounting space.
Figure 16:
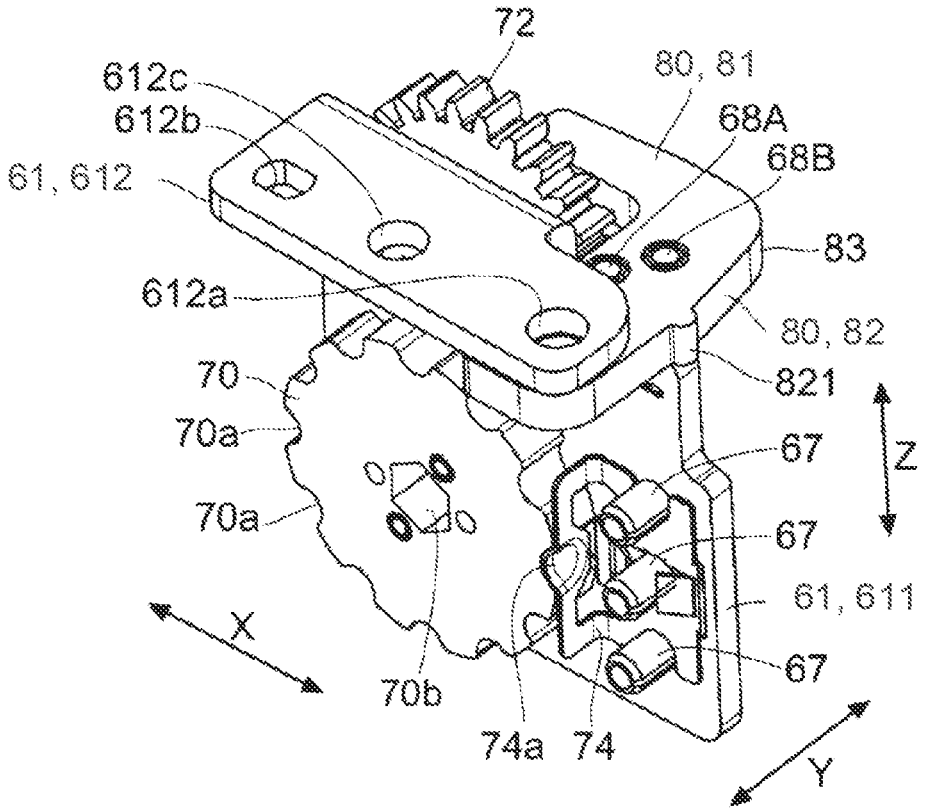
FIG. 16 is a perspective view of the adjustment mechanism of the printer according to one embodiment of the present disclosure.
Figure 17:
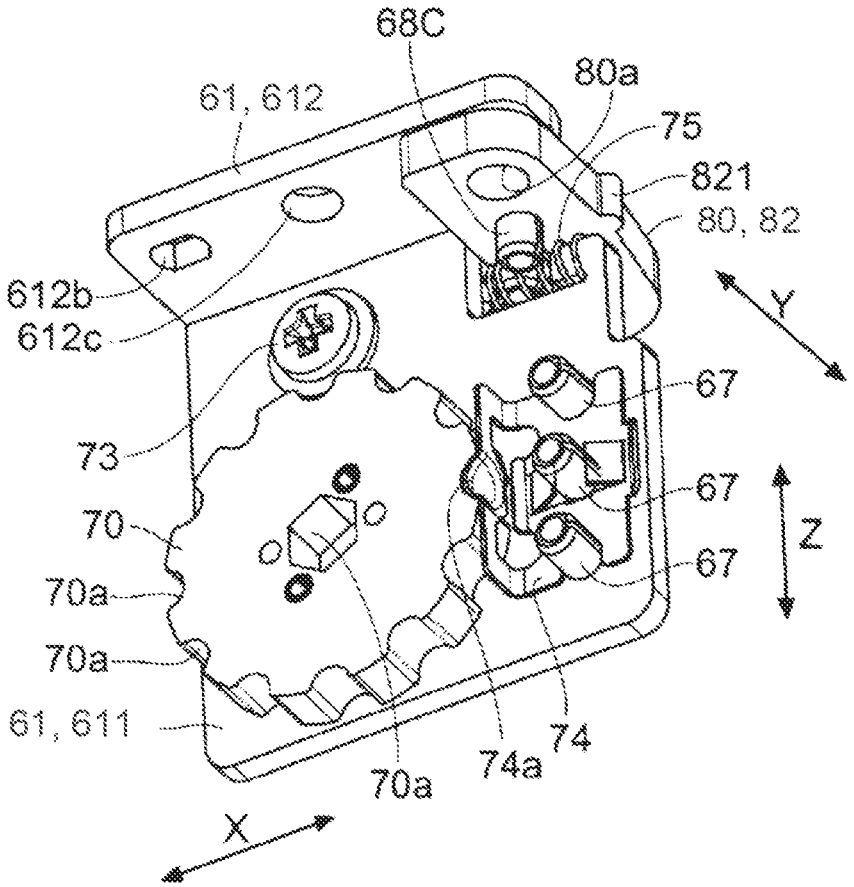
FIG. 17 is a perspective view of the adjustment mechanism of the printer according to one embodiment of the present disclosure.
Figure 18:
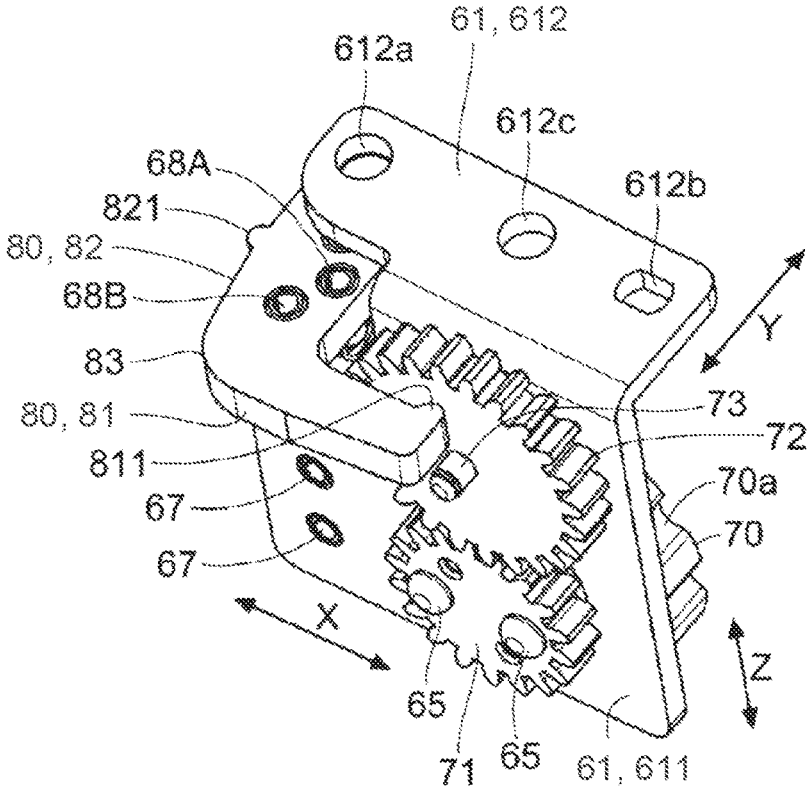
FIG. 18 is a perspective view of the adjustment mechanism of the printer according to one embodiment of the present disclosure.
Figure 19:
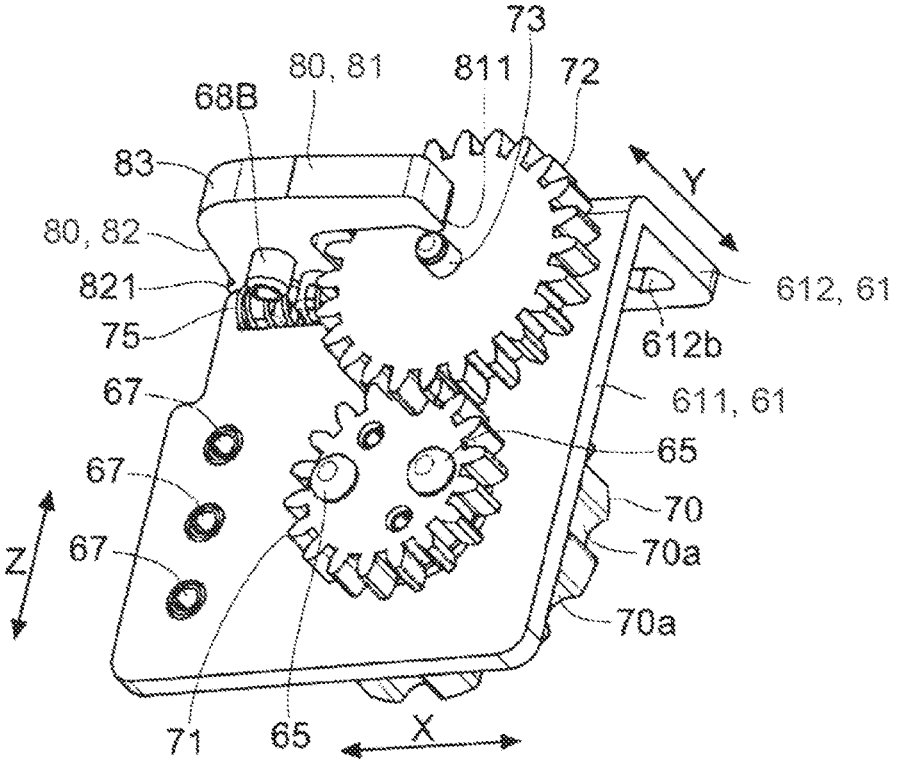
FIG. 19 is a perspective view of the adjustment mechanism of the printer according to one embodiment of the present disclosure.
Figure 20:
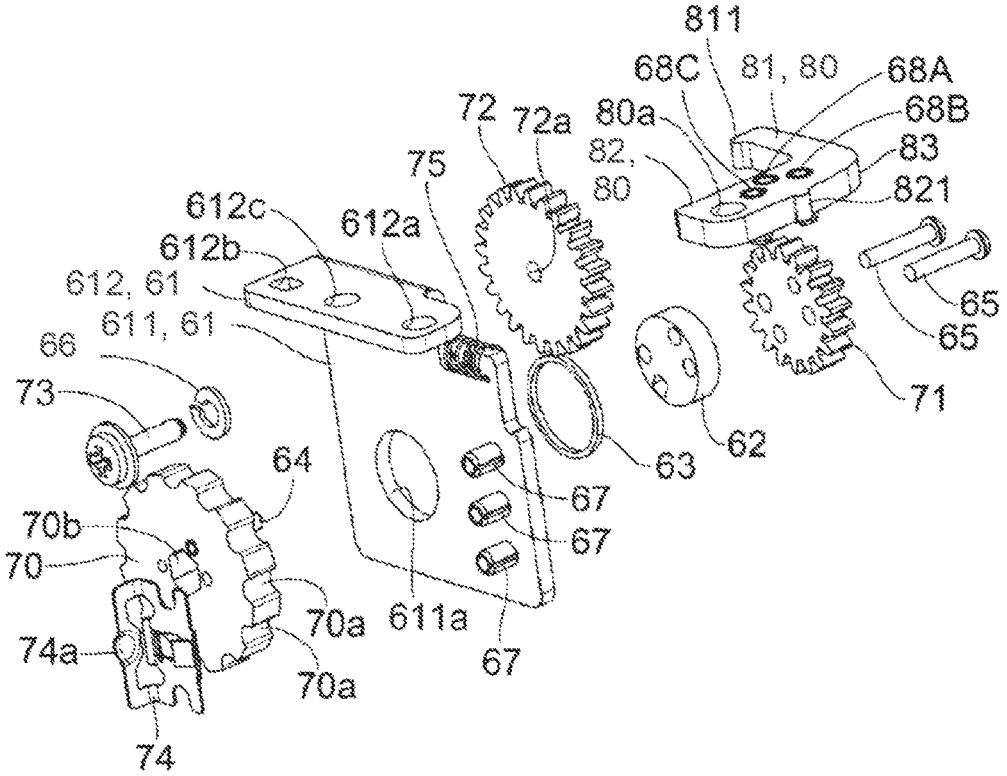
FIG. 20 is an exploded perspective view of the adjustment mechanism of the printer according to one embodiment of the present disclosure.
Figure 21:
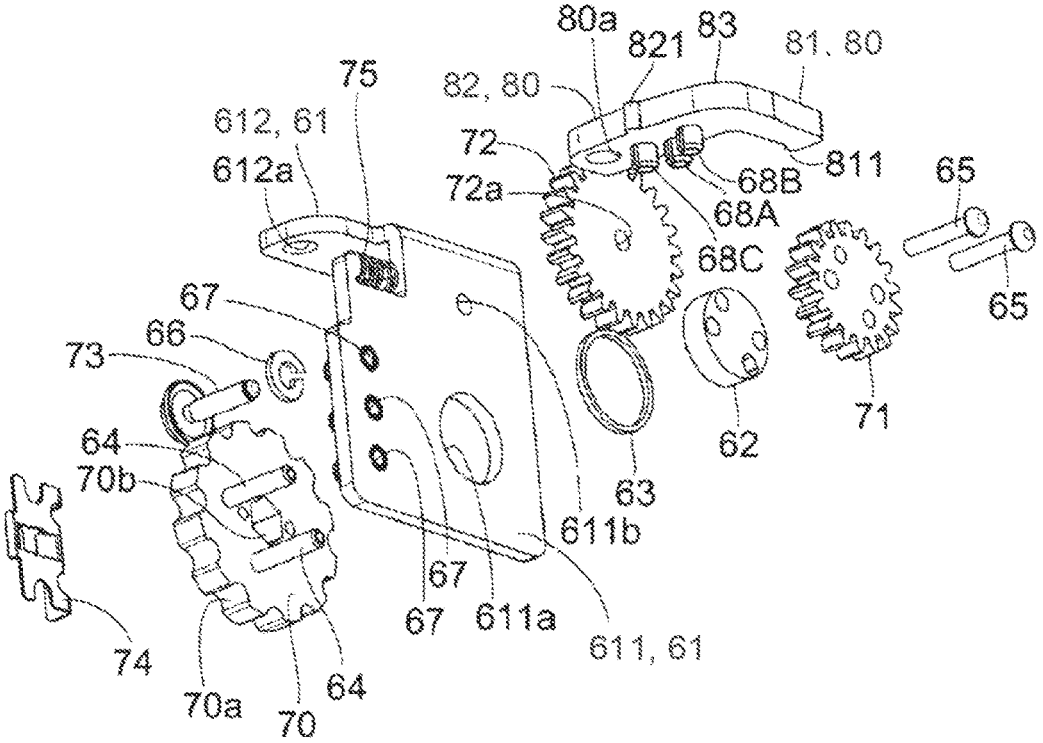
FIG. 21 is an exploded perspective view of the adjustment mechanism of the printer according to one embodiment of the present disclosure.

The attachment position of the adjustment mechanism 6 will now be described. The adjustment mechanism 6 is attached to the front mounting portion 42 of the corresponding mounting space 40. When the adjustment mechanism 6 is attached to the front mounting portion 42, the state shown in FIGS. 14 and 15 is obtained. Note that FIG. 14 is a view when the front mounting portion 42 is viewed from the outside of the mounting space 40. FIG. 15 is a view when the front mounting portion 42 is viewed from the inside of the mounting space 40. That is, each member of the adjustment mechanism 6, which will be described later, is arranged inside the mounting space 40.

Next, the configuration of the adjustment mechanism 6 will be described in detail with reference to FIGS. 16 to 21. The adjustment mechanism 6 includes a holder 61. The holder 61 is obtained by performing sheet metal processing (cutting, drilling, bending, etc.) on a metal plate material. The holder 61 has a member holding portion 611 and an attachment portion 612 bent perpendicular to the member holding portion 611. When the adjustment mechanism 6 is attached to the front mounting portion 42, the main surface of the member holding portion 611 (the surface perpendicular to the plate thickness direction) faces the main surface of the front mounting portion 42 (the surface perpendicular to the plate thickness direction) and faces also the Y direction. That is, the normal direction of the main surface of the member holding portion 611 is the Y direction.

The member holding portion 611 has a circular connecting hole 611*a* that goes through the plate thickness direction. A connecting member 62 having a disc-like shape is fitted into the connecting hole 611*a*. The connecting member 62 is obtained by performing sheet metal processing (laser cutting processing, etc.) on a metal plate material. The connecting member 62 can rotate while being fitted in the connecting hole 611*a* (the fitting tolerance is made by clearance fitting).

The thickness of the connecting member 62 is larger than the plate thickness of the holder 61. For example, the connecting member 62 is fitted into the connecting hole 611*a* so that a part of the connecting member 62 projects rearward in the Y direction. An annular spacer 63 is fitted in the projection portion of the connecting member 62. The spacer 63 can be obtained by performing laser cutting or the like on a metal plate material.

An operation member 70 with a disc-like shape is arranged on the front side of the member holding portion 611 in the Y direction. The operation member 70 is obtained by performing laser cutting or the like on a metal plate material.

A plurality of concave portions 70*a* recessed in an arc shape are formed on the outer peripheral surface of the operation member 70. The plurality of concave portions 70*a* are arranged at a predetermined pitch in the circumferential direction.

Further, a hexagonal hole 70*b* penetrating in the plate thickness direction is formed at the center of the circle of the operation member 70. A hexagonal wrench (not shown) is inserted into the hexagonal hole 70*b*.

A small diameter gear 71 is arranged on the rear side of the member holding portion 611 in the Y direction. The small diameter gear 71 corresponds to the "first gear". The small diameter gear 71 can be obtained by performing laser cutting or the like on a metal plate material.

The small diameter gear 71 faces the operation member 70 in the Y direction with the member holding portion 611 interposed therebetween. The small diameter gear 71 is connected to the operation member 70 via a spring pin 64, in a state where the connecting member 62 is sandwiched between the small diameter gear 71 and the operation member 70. As a result, when the operation member 70 rotates, the small diameter gear 71 rotates by the same angle as the rotation angle of the operation member 70. If the fitting tolerance between the pin hole (the hole into which the spring pin 64 is inserted) formed in the small diameter gear 71 and the spring pin 64 is made by clearance fitting, the small diameter gear 71 and the operation member 70 may be fastened by using a screw 65.

Further, a large diameter gear 72 is arranged on the rear side of the member holding portion 611 in the Y direction. The large-diameter gear 72 corresponds to the "moving member" and the "second gear". The large-diameter gear 72 is obtained by performing laser cutting on a metal plate material.

The large diameter gear 72 is meshed with the small diameter gear 71. Therefore, when the operation member 70 rotates, the large-diameter gear 72 rotates together with the small diameter gear 71. That is, the large diameter gear 72 rotates in conjunction with the rotation of the operation member 70. The large diameter gear 72 has more teeth than the small diameter gear 71. Therefore, the rotation of the large-diameter gear 72 is decelerated.

A guide screw 73 is attached to the member holding portion 611. The guide screw 73 is a commercially available screw. The guide screw 73 projects from the front side of the member holding portion 611 in the Y direction to the rear side of the member holding portion 611 in the Y direction via a screw hole 611*b* formed in the member holding portion 611. That is, the axial direction of the guide screw 73 (the direction in which the screw axis of the guide screw 73 extends) is the Y direction. A shaft hole 72*a* of the large-diameter gear 72 is screwed into the guide screw 73. For example, a spring washer 66 is used to prevent the guide screw 73 from loosening. A chrysanthemum-shaped metal fixture may be used instead of the spring washer 66.

Since the guide screw 73 is screwed into the shaft hole 72*a* of the large-diameter gear 72, when the large-diameter gear 72 rotates, the large-diameter gear 72 moves in the axial direction of the guide screw 73. That is, when the operation member 70 rotates, the large-diameter gear 72 moves in the axial direction of the guide screw 73.

Further, a stopper member 74 is arranged on the front side of the member holding portion 611 in the Y direction. The stopper member 74 is obtained by performing sheet metal processing (cutting, drilling, bending, etc.) on a metal plate material. The stopper member 74 is fixed to the member holding portion 611 via a spring pin 67.

The stopper member 74 is formed so as to be elastically deformable. The stopper member 74 has a convex portion 74*a*. The convex portion 74*a* of the stopper member 74 is fitted into the concave portion 70*a* at a predetermined position, of the plurality of concave portions 70*a* of the operation member 70. The convex portion 74*b* of the stopper member 74 is urged into the direction toward the operation member 70 by an elastic force of the stopper member 74.

When the operation member 70 rotates from the state where the convex portion 74*a* of the stopper member 74 is fitted in any of the concave portions 70*a* of the operation member 70, the convex portion 74*a* gets between the concave portions 70*a* of the operation member 70 (the stopper member 74 is deformed). After that, when the operation member 70 further rotates (when another concave portion 70*a* reaches a predetermined position), the convex portion 74*a* is fitted into another concave portion 70*a* that has reached the predetermined position. The stopper member 74 functions as a rotation stopper for the operation member 70.

A spring 75 is attached to the member holding portion 611. The spring 75 corresponds to an "urging member". The use of the spring 75 will be described later.

Two positioning holes 612*a* and 612*b* are formed in the attachment portion 612. One positioning hole 612*a* is a reference hole, and the other positioning hole 612*b* is a sub-reference hole (a long hole which is long in the X direction). The positioning hole 612*a* corresponds to the "first positioning hole". Further, an attachment hole 612*c* is formed in the attachment portion 612.

The adjustment mechanism 6 further includes a lever member 80. The lever member 80 corresponds to an "adjusting member". The lever member 80 is obtained by performing laser cutting or the like on a metal plate material. The lever member 80 is formed in a substantially L shape when viewed in a plane (viewed from the Z direction). In other words, the lever member 80 has a first portion 81 extending in the X direction and a second portion 82 extending in the Y direction when viewed in a plane. Note that the thickness direction of the lever member 80 is the Z direction.

The first portion 81 of the lever member 80 is formed with a first contact portion 811 projecting forward in the Y direction. The first contact portion 811 is located at the end portion (left side in the X direction) of the first portion 81 that is on the opposite side to a connecting portion 83 with the second portion 82.

A positioning hole 80*a* penetrating in the plate thickness direction is formed in the second portion 82 of the lever member 80. The positioning hole 80*a* corresponds to a "second positioning hole". The positioning hole 80*a* is located at the end (front side in the Y direction) of the second portion 82 which is on the opposite side to the connecting portion 83 with the first portion 81.

Further, the second portion 82 is formed with a second contact portion 821 protruding to the right in the X direction. The second contact portion 821 is located in the portion of the second portion 82, between the positioning hole 80*a* and the connecting portion 83. The second contact portion 821 is formed at a position closer to the positioning hole 80*a* than the formation position of the first contact portion 811 in the lever member 80. In other words, the distance between the second contact portion 821 and the positioning hole 80*a* is shorter than the distance between the first contact portion 811 and the positioning hole 80*a*.

In addition, spring pins 68A, 68B and 68C are attached to the second portion 82. The spring pins 68A to 68C each project downward from the second portion 82 in the Z direction. The spring pin 68A is arranged so that the position in the Y direction substantially coincides with the formation position of the second contact portion 821. The spring pins 68B and 68C are arranged on the rear side and the front side of the spring pin 68A in the Y direction, respectively.

The lever member 80 is arranged below the attachment portion 612. Then, the lever member 80 is attached to the front mounting portion 42 separately from the holder 61. The lever member 80 is not attached to the holder 61. The holder 61 holds the operation member 70, the small diameter gear 71, the guide screw 73 (the large diameter gear 72 screwed into the guide screw 73), the stopper member 74, the spring 75, and the like, but does not hold the lever member 80.

Figure 22:
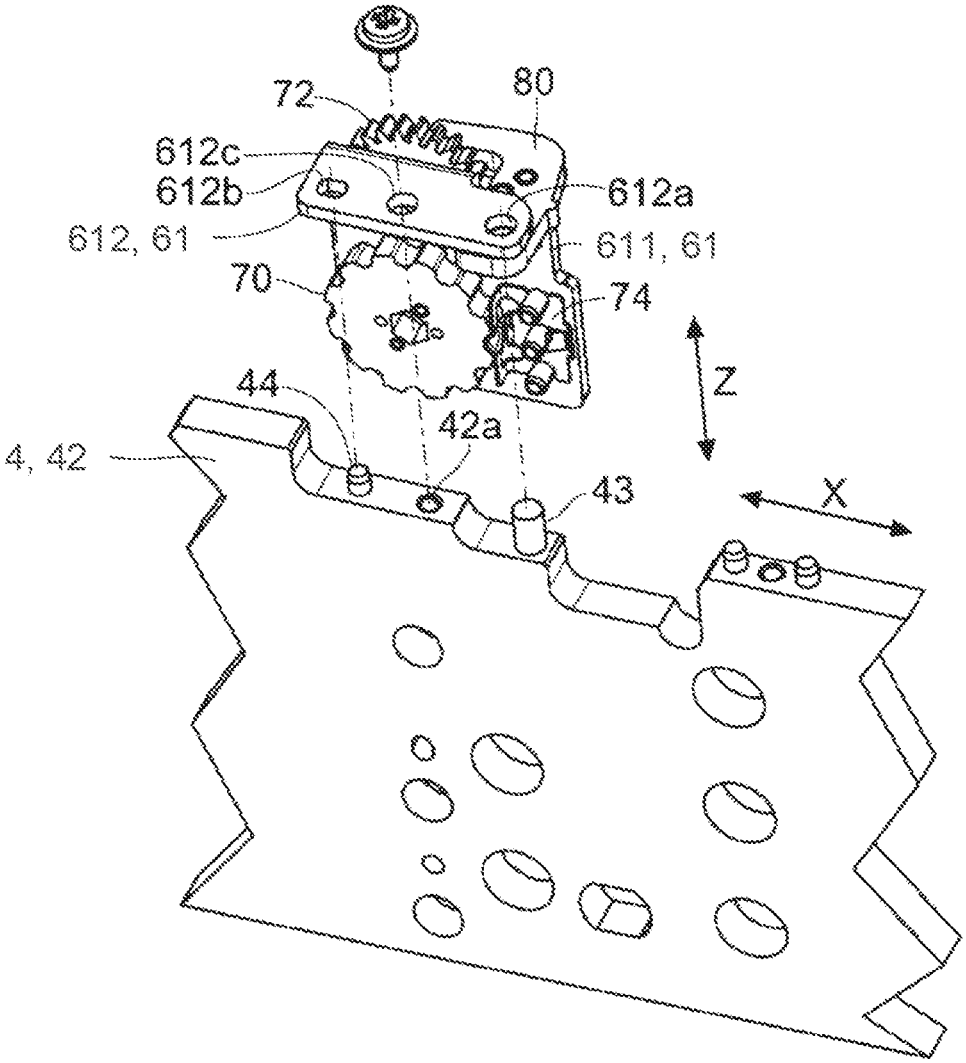
FIG. 22 is a diagram showing an attachment position of the adjustment mechanism with respect to the head base of the printer according to one embodiment of the present disclosure.
Figure 23:
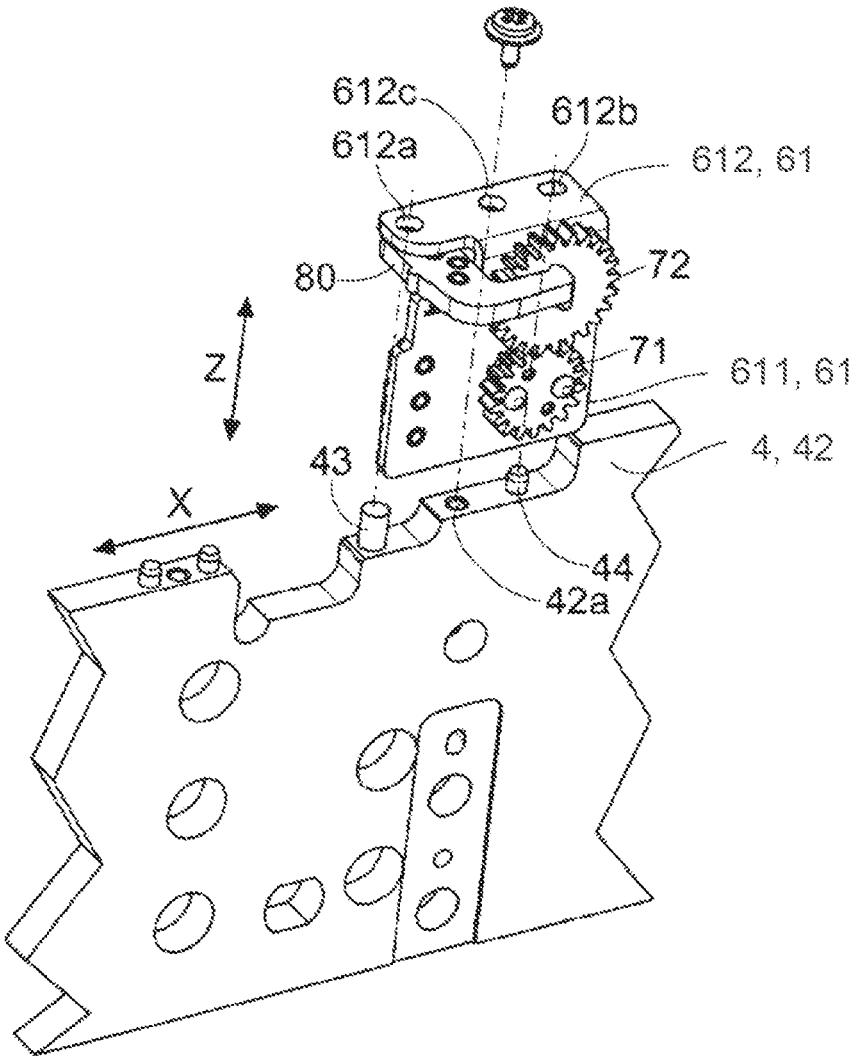
FIG. 23 is a diagram showing the attachment position of the adjustment mechanism with respect to the head base of the printer according to one embodiment of the present disclosure.

Positioning pins 43 and 44 are installed on the front mounting portion 42 of the head base 4, as shown in FIGS. 22 and 23. The positioning pins 43 and 44 are erected upright in the Z direction. Further, a screw hole 42*a* is formed in the front mounting portion 42.

The positioning pin 43 of the head base 4 is inserted into the positioning hole 80*a* of the lever member 80. The lever member 80 is held by the positioning pin 43 inserted into the positioning hole 80*a*. The lever member 80 is not screwed to the head base 4. Therefore, the lever member 80 can rotate around the positioning pin 43 as a fulcrum (the positioning pin 43 functions as a rotation axis of the lever member 80).

Further, the positioning pin 43 of the head base 4 is inserted into the positioning hole 612*a* of the holder 61 (attachment portion 612). The positioning pin 44 of the head base 4 is inserted into the positioning hole 612*b* of the holder 61. Further, the holder 61 is screwed to the head base 4. This results in a state where the adjustment mechanism 6 is attached to the head base 4.

Figure 24:
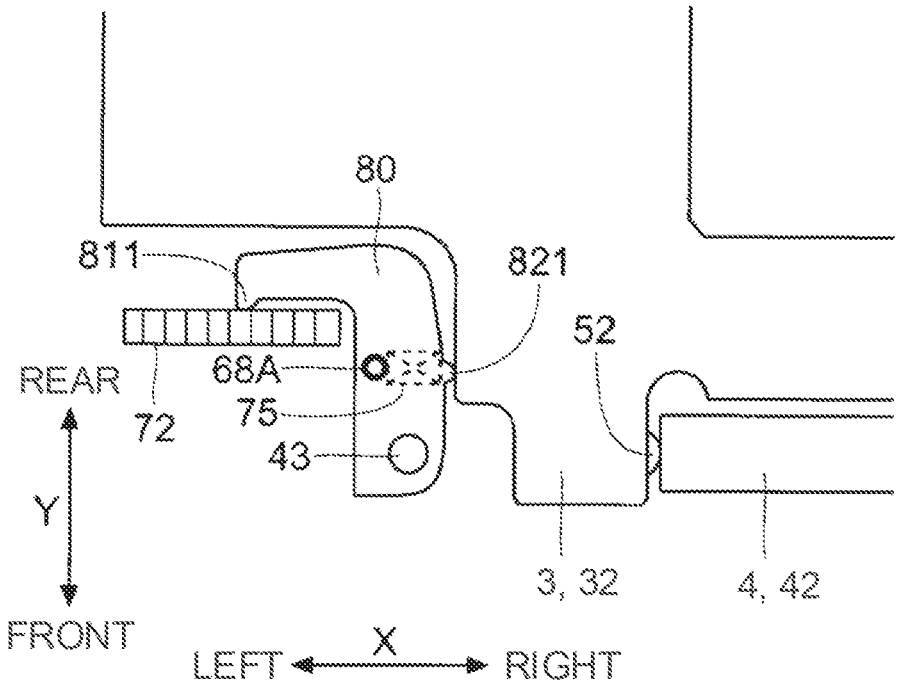
FIG. 24 is a diagram for explaining position adjustment by the printer adjustment mechanism according to one embodiment of the present disclosure.

In a state where the adjustment mechanism 6 is attached to the head base 4, as shown in FIG. 24, the first contact portion 811 of the lever member 80 comes into contact with the large diameter gear 72. Further, the spring 75 attached to the holder 61 urges the spring pin 68A of the lever member 80 to the left side in the X direction. In other words, the spring 75 urges the lever member 80 so that the first contact portion 811 rotates in the direction toward the large-diameter gear 72 around the positioning pin 43 as a fulcrum. As a result, the contact between the first contact portion 811 and the large-diameter gear 72 is maintained.

In a state where the adjustment mechanism 6 attached to the head base 4, when the large-diameter gear 72 moves to the rear side in the Y direction by rotating, the first contact portion 811 moves to the rear side in the Y direction together with the large-diameter gear 72 against the urging force of the spring 75 (the first contact portion 811 rotates clockwise around the positioning pin 43 as a fulcrum when viewed from the upper side in the Z direction). Even if the large-diameter gear 72 moves to the front side in the Y direction by rotating, the first contact portion 811 moves to the front side in the Y direction together with the large-diameter gear 72 by the urging force of the spring 75 (the first contact portion 811 rotates counterclockwise around the positioning pin 43 as a fulcrum when viewed from the upper side in the Z direction.) As a result, the contact of the first contact portion 811 with the large diameter gear 72 is maintained.

Further, in the state where the adjustment mechanism 6 is attached to the head base 4, the second contact portion 821 of the lever member 80 comes into contact with the front positioning portion 32 of the head unit 3. In the lever member 80, only the second contact portion 821 comes into contact with the head unit 3, and other parts do not come into contact with the head unit 3.

The second contact portion 821 moves to the right side in the X direction as a result that the first contact portion 811 moves to the rear side in the Y direction (the second contact portion 821 rotates clockwise around the positioning pin 43 when viewed from the upper side in the Z direction). On the other hand, the second contact portion 821 moves to the left side in the X direction as a result that the first contact portion 811 moves to the front side in the Y direction (the second contact portion 821 rotates counterclockwise around the positioning pin 43 as a fulcrum when viewed from the upper side in the Z direction). That is, the second contact portion 821 is movable in the direction toward the head unit 3 (front positioning portion 32) and in the direction away from the head unit 3 (front positioning portion 32).

Here, the head unit 3 is pressed by the first ball plunger 51, the second ball plunger 52, and the third ball plunger 53. However, the head unit 3 is not screwed to the head base 4. Further, a positioning pin 411 is inserted into the positioning hole 311 of the head unit 3 (rear positioning portion 31) (see FIG. 11).

Therefore, the portion of the head unit 3 provided with the front positioning portion 32 (hereinafter referred to as the front portion of the head unit 3) moves in the X direction in conjunction with the movement of the second contact portion 821 in the X direction. In other words, the front portion of the head unit 3 rotates around the positioning pin 411 as a fulcrum.

Specifically, when the second contact portion 821 moves to the right side in the X direction, the front portion of the head unit 3 moves to the right side in the X direction against the pressing force of the second ball plunger 52 (it rotates counterclockwise around the positioning pin 411 as a fulcrum, when viewed from the upper side in the Z direction). On the other hand, when the second contact portion 821 moves to the left in the X direction, the front portion of the head unit 3 moves to the left in the X direction due to the pressing force of the second ball plunger 52 (it rotates clockwise around the positioning pin 411, when viewed from the upper side in the Z direction).

The movement (rotation) of the second contact portion 821 of the lever member 80 in the X direction is in conjunction with the rotation of the operation member 70. The operation member 70 is prevented from rotating freely by the function of the stopper member 74. Therefore, the front portion of the head unit 3 is pressed to the left side in the X direction by the second ball plunger 52, but the movement (rotation) of the front portion of the head unit 3 in the X direction is regulated by the lever member 80. That is, the head unit 3 is in a fixed state within the mounting space 40.

By providing such an adjustment mechanism 6, the position of the head unit 3 within the mounting space 40 can be adjusted (corrected). In other words, the inclination of the head unit 3 in the Y direction can be corrected. In other words, the inclination of the main scanning line can be corrected. The position of the head unit 3 is adjusted by operating the operation member 70 (turning the operation member 70 with a hexagon wrench). That is, the position of the head unit 3 is adjusted by a person (for example, a person in charge of adjusting in the manufacturer).

Hereinafter, as an example, descriptions will be made to an operation performed when the front portion of the head unit 3 is moved to the right side in the X direction.

First, when adjusting the position of the head unit 3, it is necessary to fit a hexagon wrench into the hexagonal hole 70*b* of the operation member 70. Here, as shown in FIGS. 14 and 15, the operation member 70 is arranged inside the mounting space 40. Therefore, in the front mounting portion 42, a work hole 42*b* penetrating in the plate thickness direction is formed in its portion facing the hexagonal hole 70*b* in the Y direction. As a result, the hexagon wrench can be fitted into the hexagonal hole 70*b* from the outside of the mounting space 40 via the work hole 42*b*. The operation member 70 can be rotated by turning the hexagon wrench fitted in the hexagonal hole 70*b*.

When the front portion of the head unit 3 is moved to the right side in the X direction, the operator rotates the operation member 70 counterclockwise when viewed from the outside of the mounting space 40. As a result, the small diameter gear 71 also rotates counterclockwise. The large-diameter gear 72 rotates clockwise. A guide screw 73 is screwed into the shaft hole 72*a* of the large-diameter gear 72. As a result, when the large-diameter gear 72 rotates, the large-diameter gear 72 moves in the axial direction of the guide screw 73. The moving direction of the large-diameter gear 72 changes in accordance with the rotation direction of the large-diameter gear 72.

When the large-diameter gear 72 rotates clockwise (when the operation member 70 rotates counterclockwise), the large-diameter gear 72 moves to the rear side in the Y direction. That is, the large-diameter gear 72 moves in the direction of pressing the first contact portion 811 of the lever member 80 toward the rear side.

When the first contact portion 811 is pressed to the rear side in the Y direction, the lever member 80 rotates clockwise around the positioning pin 43 as a fulcrum when viewed from the upper side in the Z direction. That is, the second contact portion 821 of the lever member 80 moves to the right side in the X direction. As a result, the front portion of the head unit 3 is pressed to the right side in the X direction by the second contact portion 821. The front portion of the head unit 3 moves to the right side in the X direction against the pressing force of the second ball plunger 52. Note that if it is desired to move the front portion of the head unit 3 to the left side in the X direction, the operation member 70 may be rotated clockwise.

Here, it is assumed that the concave portions 70*a* on the outer peripheral surface of the operation member 70 are formed at a pitch of 30° in the circumferential direction. That is, it is assumed that the number of concave portions 70*a* formed is 12. Further, it is assumed that the small diameter gear 71 has 18 teeth and the large diameter gear 72 has 24 teeth. Further, it is assumed that the screw pitch of the guide screw 73 is 0.5 mm. In addition, it is assumed that the ratio of the lever member 80 is 0.5.

In this example, when performing the adjustment of the position of the head unit 3, the operator can rotate the operation member 70 by exactly 30°. When the operation member 70 rotates by 30°, the convex portion 74*a* is fitted into the concave portion 70*a* adjacent in the circumferential direction to the concave portion 70*a* in which the convex portion 74*a* of the stopper member 74 is fitted before the rotation. As a result, every time the operator rotates the operation member 70 by 30°, the operator is given a click feeling.

When the operation member 70 is rotated by 30° (when the operation member 70 is rotated by one click), the large-diameter gear 72 that meshes with the small diameter gear 71 is rotated by 22.5° (decelerated). When the large-diameter gear 72 is rotated by 22.5°, the screw pitch of the guide screw 73 is 0.5 mm, so that the large-diameter gear 72 moves 0.03125 mm in the axial direction of the guide screw 73. Further, since the ratio of the lever member 80 is 0.5, the second contact portion 821 of the lever member 80 moves 0.015625 mm in the X direction. The front portion of the head unit 3 moves in the X direction by an amount corresponding to the amount of movement of the second contact portion 821 in the X direction.

As described above, the printer 100 (inkjet printer) of the present embodiment includes the head base 4 having the mounting space 40, the head unit 3 including the recording head 310 for ejecting ink, and the adjustment mechanism 6 for adjusting the position of the head unit 3 inserted in the mounting space 40. The adjustment mechanism 6 has the guide screw 73, the large-diameter gear 72 (moving member, the second gear), the operation member 70, and the lever member 80 (adjusting member). The large-diameter gear 72 has the shaft hole 72*a* engaged with the guide screw 73, rotates with respect to the guide screw 73, thereby moving in the axial direction of the guide screw 73 (moving member, second gear). The operation member 70 is to rotate the large-diameter gear 72. The lever member 80 has the first contact portion 811 that comes into contact with the large-diameter gear 72 and the second contact portion 821 that comes into contact with the head unit 3.

Further, the adjustment mechanism 6 includes a small diameter gear 71 (first gear). The small diameter gear 71 is connected to the operation member 70, and when the operation member 70 rotates, it rotates by the same angle as the rotation angle of the operation member 70. Then, since the large diameter gear 72 is meshed with the small diameter gear 71, the large diameter gear 72 rotates in conjunction with the rotation of the operation member 70.

The lever member 80 is rotatable around a positioning pin 43 provided on the head base 4. When the large-diameter gear 72 that comes into contact with the first contact portion 811 moves in the axial direction of the guide screw 73, the second contact portion 821 rotates in a direction toward the front portion of the head unit 3 and in a direction away from the front portion of the head unit 4.

In the configuration of the present embodiment, the small diameter gear 71 is connected to the operation member 70 that is rotated by the operation of the operator, and the small diameter gear 71 is meshed with the large diameter gear 72 having the shaft hole 72*a* fitted into the guide screw 73. As a result, the second contact portion 821 of the lever member 80 that comes into contact with the front portion of the head unit 3 can be moved in the X direction with a simple configuration. When the second contact portion 821 moves in the X direction, the front portion of the head unit 3 moves in the X direction (the front portion of the head unit 3 rotates around the positioning pin 411). That is, in the configuration of the present embodiment, the position (tilt adjustment) of the head unit 3 can be performed with a simple configuration.

Here, it is possible to obtain the main members of the adjustment mechanism 6, such as the operation member 70, the small diameter gear 71, the large diameter gear 72, and the lever member 80, by laser-cutting a metal plate material. The guide screw 73 is a commercially available screw. Therefore, the adjustment mechanism 6 can be obtained without creating a new mold. This enables to suppress an increase in cost.

In addition, the large-diameter gear 72 has more teeth than the small diameter gear 71. Further, the second contact portion 821 of the lever member 80 is formed at a position closer to the positioning hole 80*a* (second positioning hole), into which the positioning pin 43 is inserted, than the formation position of the first contact portion 811. As a result, the amount of movement of the second contact portion 821 of the lever member 80 can be reduced with respect to the rotation angle of the operation member 70. As a result, the position of the front portion of the head unit 3 can be finely adjusted easily and accurately.

Further, in the present embodiment, as described above, the positioning hole 612*a* (first positioning hole) into which the positioning pin 43 is inserted is formed in the holder 61, and the positioning hole 80*a* (second positioning hole) into which the positioning pin 43 is inserted is formed on the lever member 80. As a result, the holder 61 is positioned with reference to the positioning pin 43, and the lever member 80 is also positioned with reference to the positioning pin 43. As a result, the cumulative tolerance can be reduced.

Further, in the present embodiment, as described above, the stopper member 74 that functions as a detent for the operation member 70 is installed. Here, a plurality of concave portions 70*a* are formed in the operation member 70 at a predetermined pitch, and the convex portion 74*a* fitted into the concave portion 70*a* at a predetermined position is formed in the stopper member 74. In this configuration, the operator can surely rotate the operation member 70 by a predetermined pitch. As a result, it is possible to suppress the inconvenience that the operation member 70 cannot be finely rotated (fine adjustment cannot be performed). Further, from the viewpoint of the operator, a click feeling is obtained every time the operation member 70 is turned by a predetermined pitch, thus achieving good workability (it is easy to understand how much the operation member 70 has been turned).

Further, in the present embodiment, as described above, the lever member 80 is always urged by the spring 75. As a result, it is possible to suppress separation of the first contact portion 811 of the lever member 80 from the large-diameter gear 72.

Further, in the present embodiment, as described above, the head unit 3 is pressed by the first ball plunger 51, the second ball plunger 52, and the third ball plunger 53 in the mounting space 40 so as to be fixed thereby. By fixing the head unit 3 using such a method, when the operator operates the operation member 70, the ball of each ball plunger moves toward the inside of the plunger case, and also the ball of each ball plunger rolls. As a result, the head unit 3 can be moved smoothly.

It is naturally appreciated that the embodiment described above is illustrative only in every aspect and is not to be construed as limiting. The scope of the present disclosure is shown by the scope of claims rather than by the description of the embodiment given above. Further, the present disclosure includes those modifications within the meaning and the scope equivalent to the scope the appended claims.

What is claimed is:

1. An inkjet recording device comprising:

a head base having a mounting space;

a head unit including a recording head for ejecting ink; and an adjustment mechanism for adjusting a position of the head unit inserted in the mounting space, within the mounting space, wherein the adjustment mechanism includes a guide screw, a moving member having a shaft hole into which the guide screw is screwed, and moving in an axial direction of the guide screw by rotating with respect to the guide screw, an operation member for rotating the moving member, and an adjusting member having a first contact portion in contact with the moving member and a second contact portion in contact with the head unit, and the second contact portion moves in a direction toward the head unit and a direction away from the head unit, by moving the moving member in contact with the first contact portion in the axial direction of the guide screw, wherein:

the adjustment mechanism further has a holder;

the head base has a positioning pin;

the holder has a first positioning hole, into which the positioning pin is inserted, and holds the guide screw, the operation member, and the moving member; and the adjusting member has a second positioning hole, into which the positioning pin is inserted, and is not held by the holder, but held by the positioning pin inserted into the second positioning hole.

2. The inkjet recording device according to claim 1, wherein the second contact portion rotates in a direction toward the head unit and away from the head unit around the positioning pin as a fulcrum, when the moving member in contact with the first contact portion moves in the axial direction of the guide screw.

3. The inkjet recording device according to claim 2, wherein a distance between the second contact portion and the second positioning hole is shorter than a distance between the first contact portion and the second positioning hole.

4. An inkjet recording device comprising:

a head base having a mounting space;

a head unit including a recording head for ejecting ink; and an adjustment mechanism for adjusting a position of the head unit inserted in the mounting space, within the mounting space, wherein the adjustment mechanism includes a guide screw, a moving member having a shaft hole into which the guide screw is screwed, and moving in an axial direction of the guide screw by rotating with respect to the guide screw, an operation member for rotating the moving member, and an adjusting member having a first contact portion in contact with the moving member and a second contact portion in contact with the head unit, and the second contact portion moves in a direction toward the head unit and a direction away from the head unit, by moving the moving member in contact with the first contact portion in the axial direction of the guide screw, wherein:

the adjustment mechanism further includes a first gear;

the first gear is connected to the operation member, and when the operation member rotates, the first gear rotates by a same angle as a rotation angle of the operation member;

a second gear having a larger number of teeth than number of teeth of the first gear is used as the moving member; and the second gear is meshed with the first gear, so that the second gear as the moving member rotates in conjunction with rotation of the operation member.

5. An inkjet recording device comprising:

a head base having a mounting space;

a head unit including a recording head for ejecting ink; and an adjustment mechanism for adjusting a position of the head unit inserted in the mounting space, within the mounting space, wherein the adjustment mechanism includes a guide screw, a moving member having a shaft hole into which the guide screw is screwed, and moving in an axial direction of the guide screw by rotating with respect to the guide screw, an operation member for rotating the moving member, and an adjusting member having a first contact portion in contact with the moving member and a second contact portion in contact with the head unit, and the second contact portion moves in a direction toward the head unit and a direction away from the head unit, by moving the moving member in contact with the first contact portion in the axial direction of the guide screw, wherein:

the adjustment mechanism further includes a stopper member;

the operation member has a disc-like shape;

an outer peripheral surface of the operation member has a plurality of concave portions arranged at a predetermined pitch in a circumferential direction;

the stopper member has a convex portion fitted into the concave portion at a predetermined position among the plurality of the concave portions; and the convex portion is urged in a direction toward the operation member.

6. The inkjet recording device according to claim 2, wherein:

the adjustment mechanism further includes an urging member; and the urging member urges the adjusting member to bring the first contact portion into contact with the moving member.

7. An inkjet recording device comprising:

a head base having a mounting space;

a head unit including a recording head for ejecting ink; and an adjustment mechanism for adjusting a position of the head unit inserted in the mounting space, within the mounting space, wherein the adjustment mechanism includes a guide screw, a moving member having a shaft hole into which the guide screw is screwed, and moving in an axial direction of the guide screw by rotating with respect to the guide screw, an operation member for rotating the moving member, and an adjusting member having a first contact portion in contact with the moving member and a second contact portion in contact with the head unit, and the second contact portion moves in a direction toward the head unit and a direction away from the head unit, by moving the moving member in contact with the first contact portion in the axial direction of the guide screw, wherein the head base has a positioning pin, and the second contact portion rotates in a direction toward the head unit and away from the head unit around the positioning pin as a fulcrum, when the moving member in contact with the first contact portion moves in the axial direction of the guide screw.

* * * * *